United States Patent [19]

Tomura et al.

[11] 3,978,368

[45] Aug. 31, 1976

[54] DISCHARGE LAMP CONTROL CIRCUIT

[75] Inventors: Teruichi Tomura, Kunitachi; Hiroyuki Iyama; Mitsuo Akatsuka, both of Tokyo, all of Japan

[73] Assignee: Hitachi, Ltd., Japan

[22] Filed: Feb. 21, 1974

[21] Appl. No.: 444,506

[30] Foreign Application Priority Data

| | | |
|---|---|---|
| Feb. 21, 1973 | Japan | 48-20173 |
| Mar. 2, 1973 | Japan | 48-25413 |
| July 11, 1973 | Japan | 48-77483 |
| July 11, 1973 | Japan | 48-77485 |

[52] U.S. Cl. ..... 315/99; 315/101; 315/105

[51] Int. Cl.[2] ..... H05B 41/04; H05B 41/18

[58] Field of Search ..... 315/105, DIG. 5, DIG. 7, 315/101, 94, 102, 97, 98, 99; 307/252 J, 252 C, 252 N

[56] References Cited

UNITED STATES PATENTS

| | | | |
|---|---|---|---|
| 3,204,123 | 8/1965 | Mahoney et al. | 307/274 X |
| 3,287,662 | 11/1966 | Walker | 331/111 |
| 3,440,488 | 4/1969 | Skirvin | 315/100 X |
| 3,643,127 | 2/1972 | Laupman | 315/101 |
| 3,659,150 | 4/1972 | Laupman | 315/DIG. 5 X |
| 3,705,329 | 12/1972 | Vogeli | 315/DIG. 5 X |
| 3,767,970 | 10/1973 | Collins | 315/DIG. 5 X |
| 3,836,817 | 9/1974 | Ischang et al. | 315/DIG. 5 X |

*Primary Examiner*—Robert Segal
*Attorney, Agent, or Firm*—Craig & Antonelli

[57] ABSTRACT

A voltage producing device comprises a circuit in which an AC power source, a coil and a first capacitor connected in series. A unidirectional triode semiconductor switching element is connected across both terminals of the capacitor, a voltage limiting semiconductor element is connected to a gate electrode of the switching element, and a charging-and-discharging circuit including a second capacitor is connected to a cathode of the switching element.

8 Claims, 49 Drawing Figures

FIG. 7(a)
FIG. 7(b)
FIG. 7(c)
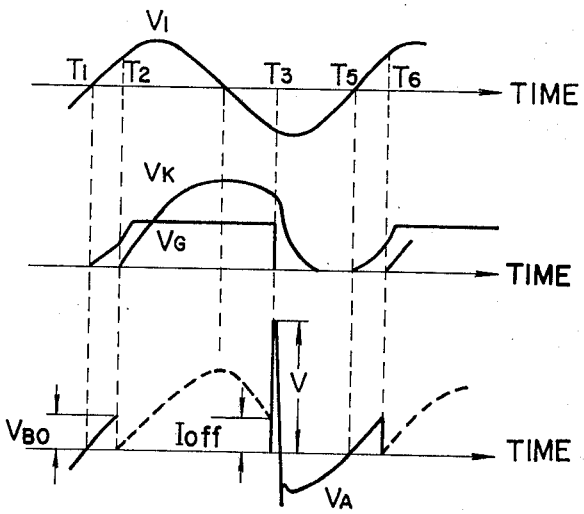
FIG. 8
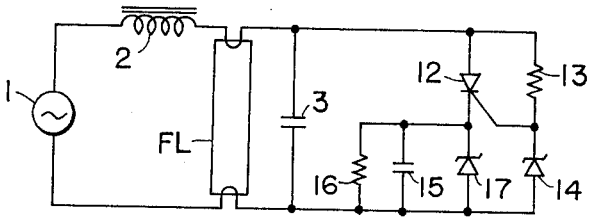
FIG. 9
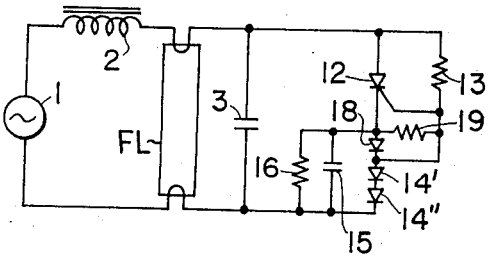
FIG. 10
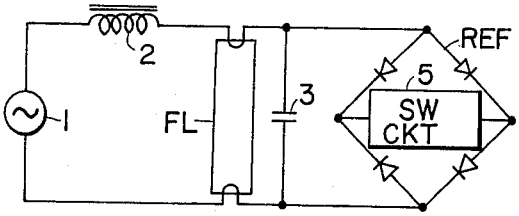
FIG. 11
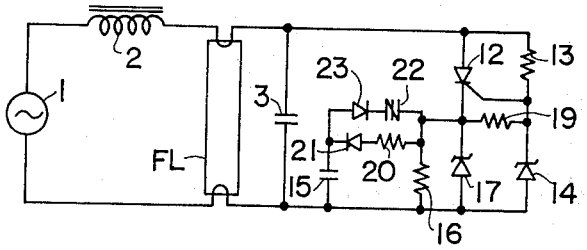
FIG. 12
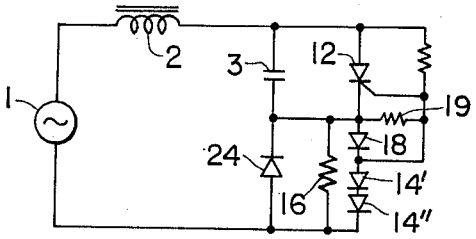
FIG. 13
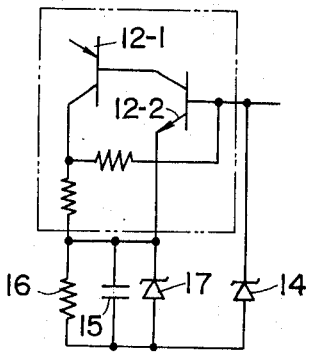

FIG. 14
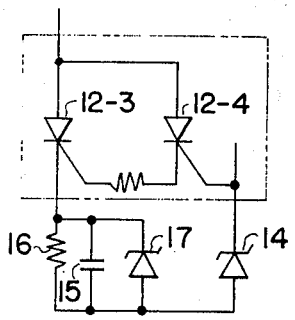
FIG. 15
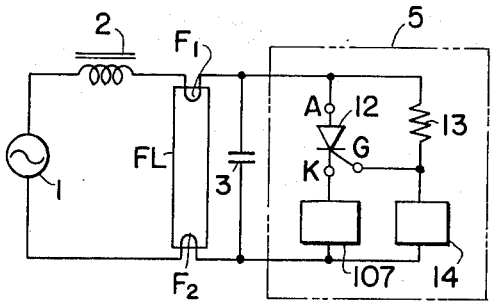
FIG. 16(a)
FIG. 16(b)
FIG. 16(c)
FIG. 16(d)
FIG. 16(e)
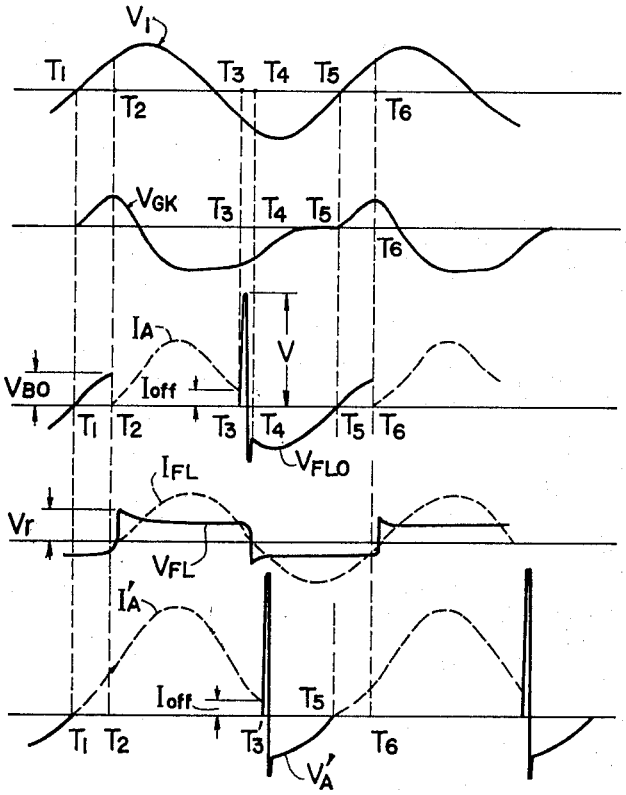
FIG. 17
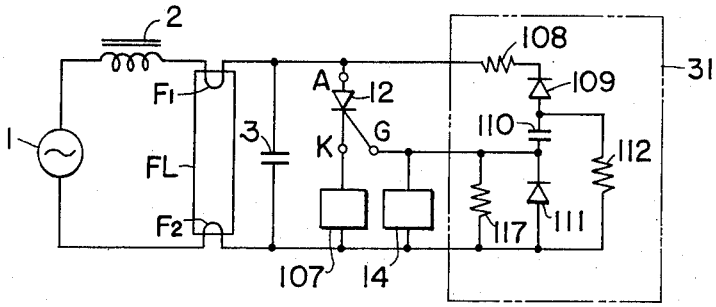

FIG. 24
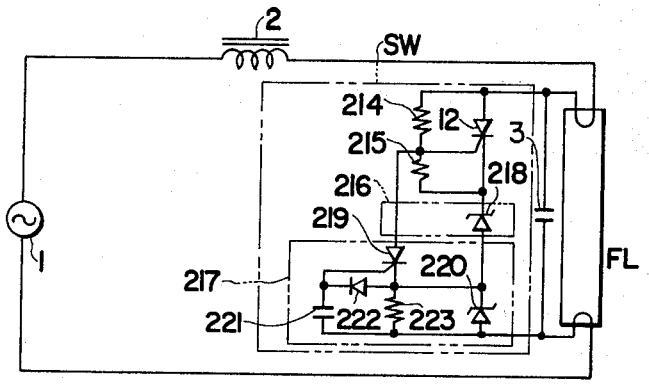
FIG. 25(b)
FIG. 25(c)
FIG. 25(d)
FIG. 25(e)
FIG. 25(a)
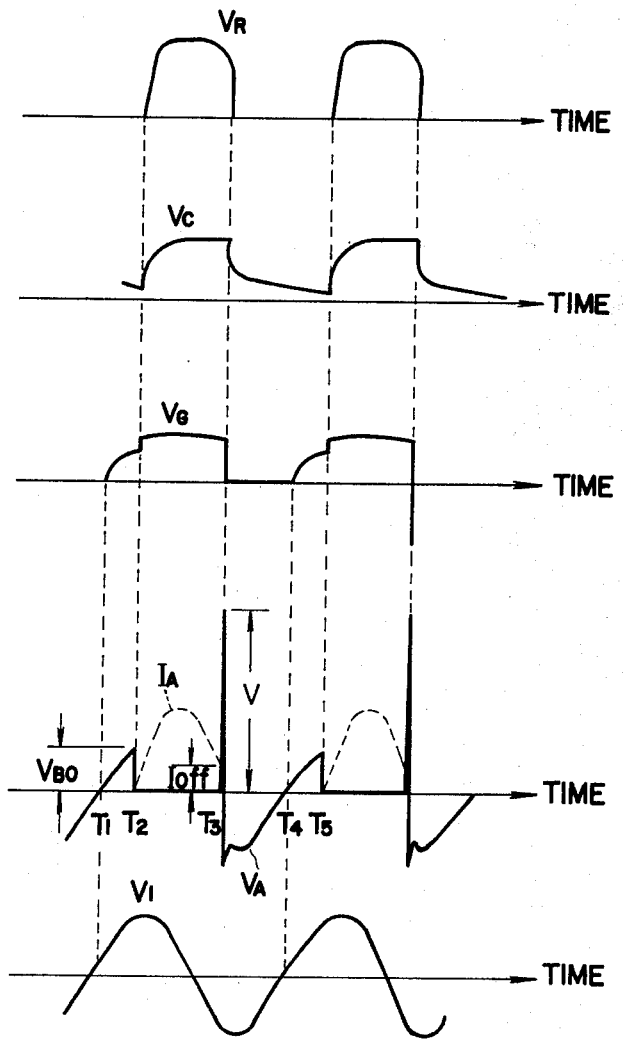

FIG. 31
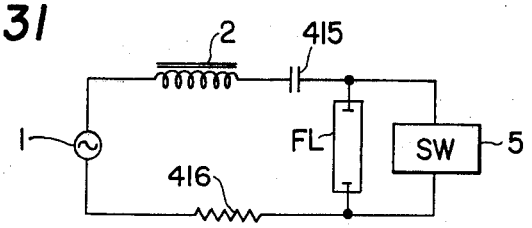
FIG. 32(a)
FIG. 32(b)
FIG. 32(c)
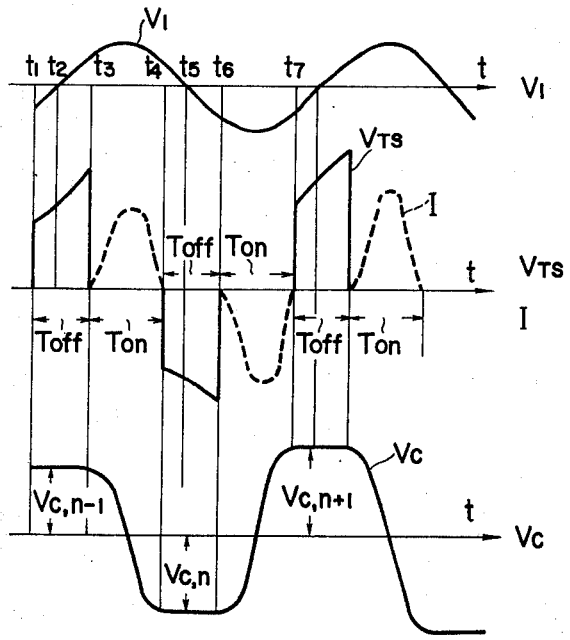
FIG. 33
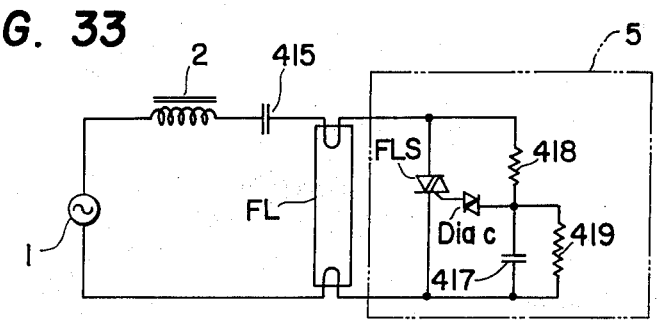

DISCHARGE LAMP CONTROL CIRCUIT

BACKGROUND OF THE INVENTION

The present invention relates to a voltage producing device and, more particularly, to a voltage producing device employing a solid state switch.

DESCRIPTION OF THE PRIOR ART

As is well known, when a switch is closed and opened in a circuit arrangement as shown in FIG. 1, a pulse is generated. In the figure, numeral 1 designates an AC power source, 2 a coil, 3 a capacitor, 5 a switching circuit, and 4 a resistance component existent in parallel with the switching circuit. The capacitor 3 need not be added, but a capacitance equivalently existent in the form of the distributed capacitance of the winding of the coil 2 may be used. Although loss components such as the winding resistance of the coil and the circuit resistance are omitted from the illustration, they can be considered as being included in the resistance 4.

Assuming now that the switch 5 is turned "on" at a time $t_1$ in FIG. 2, the terminal voltage V becomes zero. As is shown in the figure, the current flowing through the switch is a pulse current, short-circuiting the capacitor 3, and gradually increases by the operation of the coil 2. Subsequently, when the switch 5 is turned "off" at a time $t_2$, the voltage and current polarities are reversed. Accordingly, if the current at the time of the turn-off of the switch 5 is low, a peak 7 will be produced as the main constituent. On the other hand, if the current is high, a peak 6 is produced as the main constituent.

In this state, the peaks cancel each other, and the resultant peak has a low level.

Let L, C and R be the values of the coil 2, the capacitor 3 and the resistance 4 in FIG. 1, respectively. Then, as is well known, the oscillation waveform has a resonant frequency substantially equal to $1/(2\pi\sqrt{LC})$ and is attended by a damping: exp $(-t/2\ RC)$. The amplitude consists of a $\sqrt{L/C}\ I_H$ component based on the current $I_H$ (the magnitude shall also be indicated by $I_H$) at the cut-off of the switch and the supply voltage $V_o$ (the magnitude shall also be denoted by $V_o$) applied after cut-off. The times at which the peaks appear are the ¼ oscillation period and the ½ oscillation period after cut-off. Considering these peaks, the amplitudes have substantially the following values:

Regarding the peak 6, $$V_6 \simeq \sqrt{\frac{L}{C}}\ I_H e^{-\frac{\pi}{4R}\sqrt{\frac{L}{C}}} - V_o$$

As to the peak 7, $$V_7 \simeq (1 + e^{-\frac{\pi}{2R}\sqrt{\frac{L}{C}}})\ V_o.$$

For peak 6 an arbitrary high voltage pulse is obtained by selecting a large value for the current $I_H$, whereas for peak 7 a value of 2 $V_o$ is the limit.

As means for generating the former pulse $V_6$, there have been employed a mechanical switch employing contacts, a high withstand voltage transistor switch separately having a driver circuit, etc.

For $V_7$, however, a generator has been simply constructed with a diode or by connecting a diode in series with an SSS (silicon symmetrical switch) and has, therefore, been utilized in a fluorescent lamp lighting circuit, etc. It is, however, disadvantageous in that the pulse voltage is low.

A unidirectional triode semiconductor switching element such as an SCR (silicon controlled rectifier) has a characteristic shown in FIG. 3. When a voltage greater than the break-over voltage $V_{Bo}$ which is determined by a current caused to flow through a gate electrode is applied, the element becomes conductive and a holding current $I_H$ starts flowing. Subsequently, when the current decreases and becomes less than the current $I_{off}$ at cut-off, the element becomes non-conductive and returns to its original open state. Consequently, if the holding current $I_H$, in other words the current $I_{off}$, can be made high and the turn-off time short, it will become possible to generate pulses of large voltage values in a self-oscillation manner.

Accordingly, if the cut-off current $I_{off}$ can be made high, it will be possible to provide a high voltage pulse to be generated at cut-off.

However, as the generated pulse reaches a higher voltage, a larger current flows through the gate electrode; the SCR turns on again, to absorb the generated pulse.

In order to obtain a high voltage pulse, therefore, it is necessary to make the cut-off current high and, simultaneously, to eliminate the absorption of the generated pulse.

With reference to FIG. 4, description will be made of a principle for realizing a pulse which is great in the voltage value. When a voltage is applied to the element, the break-over voltage decreases as is shown by a broken line 10 in the figure, and the element turns on at a breakover voltage lower than the maximum value of the supply voltage.

The current varies following the supply voltage. Before it decreases to the holding current $I_H$, the breakover voltage is recovered to a sufficiently large value. When the current decreases to $I_{off}$, the element is opened and a pulse as shown at 11 is produced. Since the time of the production of the peak is $\pi/2\sqrt{LC}$ as explained above, the turn-off time or the recovery time of the element must be shorter than this value.

On the other hand, the unidirectional triode semiconductor switching element undergoes a gate current $I_G$ due to a voltage applied to the gate electrode and is varied in its holding current $I_H$ as shown in FIG. 5. This figure indicates that the holding current of the element increases when the gate and cathode of the element is zero-biased or have a reverse-bias applied therebetween.

SUMMARY OF THE INVENTION

In view of the above points, the present invention provides a voltage producing device in which a semiconductor switching element with a control electrode has its holding current increased and its turn-off time made short and is free from the absorption of a pulse.

In order to accomplish this object, the present invention passively or actively supplies a voltage for maintaining the turn-off of the switching element between the control electrode and a current outflow terminal of the semiconductor switching element.

The present invention will be described hereunder with reference to the accompanying drawings.

BRIEF DESCRIPTION OF THE DRAWING

FIGS. 7*a* –7*c* are diagrams for explaining the operation of the embodiment of FIG. 6;

FIGS. 8–12 are diagrams each showing the construction of another embodiment of the present invention;

FIGS. 13 and 14 are diagrams each showing the construction of the essential portions of still another embodiment of the present invention;

FIG. 15 is a diagram showing a voltage producing device for explaining a further embodiment of the present invention;

FIGS. 16*a*–16*e* are diagrams for explaining the operation of the device in FIG. 15;

FIGS. 17–22 are diagrams each showing a different embodiment of the present invention;

FIG. 24 is a diagram showing the construction of the further embodiment of the present invention;

FIGS. 25*a*–25*e* are diagrams for explaining the operation of the embodiment in FIG. 24;

FIG. 31 is a diagram showing a voltage producing device for explaining another embodiment of the present invention;

FIGS. 32*a*–32*c* are diagrams for explaining the operation of the device shown in FIG. 31; and FIGS. 33–37 are diagrams showing the constructions of different embodiments of the present invention.

Figure 1:
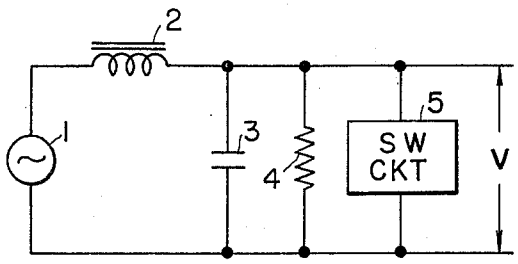
FIG. 1 is a diagram of a prior-art circuit for producing pulses.
Figure 2:
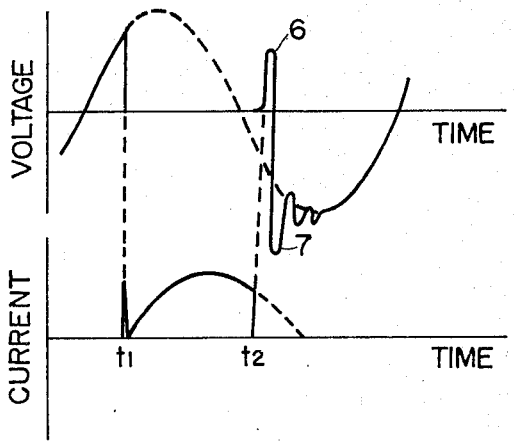
FIGS. 2–4 are diagrams for explaining the operation of the prior art circuit.
Figure 4:
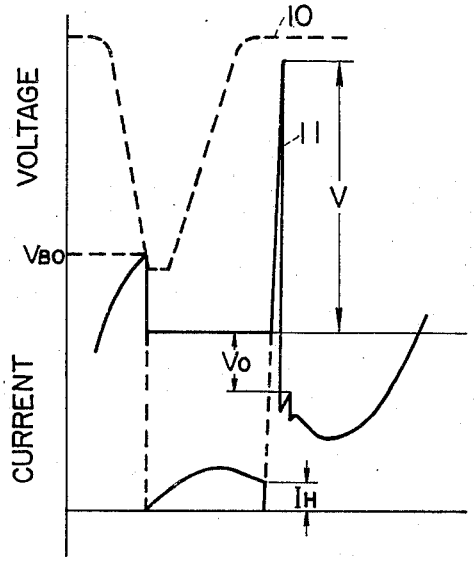
Figure 3:
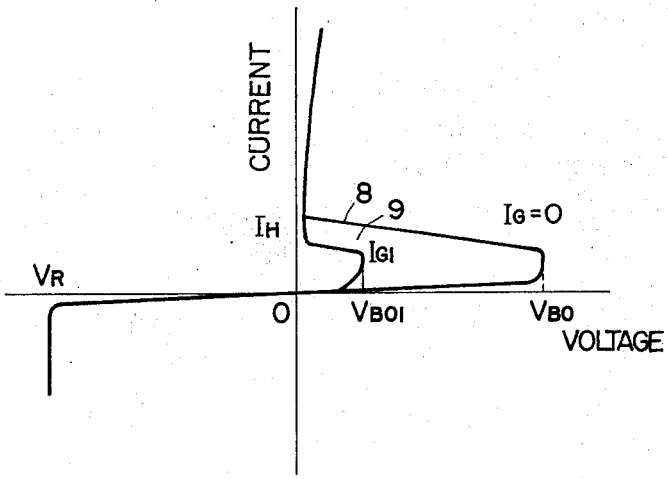
Figure 5:
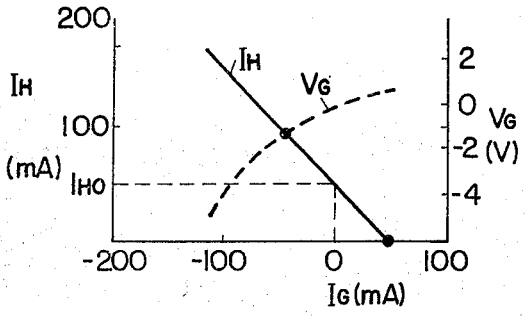
FIG. 5 is a diagram of the characteristic curve of an SCR.
Figure 6:
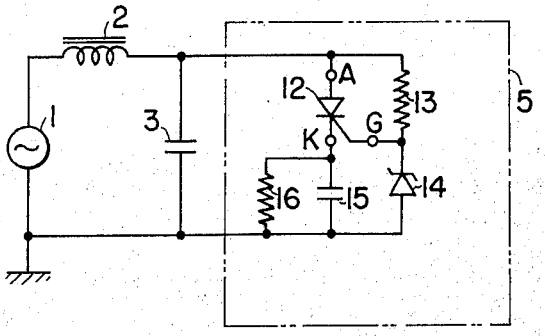
FIG. 6 is a circuit diagram showing the construction of an embodiment of the present invention.

DESCRIPTION OF THE PREFERRED EMBODIMENTS:

FIG. 6 illustrates an embodiment of the present invention, in which the same symbols as in FIG. 1 indicate the same or equivalent parts. A unidirectional triode semiconductor switching element 12, such as an SCR has an anode terminal A, a gate terminal G and a cathode terminal K. Numeral 14 denotes a nonlinear voltage limiting element, which is herein a Zener diode.

A capacitor 15 is connected in parallel with a discharging resistance 16. Shown at 13 is a resistance for supplying a gate current. The voltage between the terminal A and ground is divided by the resistance 13 and the voltage limiting element 14, and the voltage across the resistance 13 is applied to the gate G. The resistance 13 should desirably have a resistance value which is low enough to cause the gate current for turn-on to flow and which is as high as possible so as not to absorb a generated pulse voltage.

The operation of the circuit will be explained with reference to FIGS. 7*a*– 7*c*.

FIG. 7*a* shows the voltage waveform of the AC power source 1, while FIG. 7*b* shows the waveforms of the potential $V_K$ of the cathode terminal K and the potential $V_G$ of the gate terminal G. FIG. 7*c* shows the potential $V_A$ (solid line) of the anode terminal A and the anode current $I_A$ (broken line) of the switching element 12.

At a time $T_1$, the capacitor 15 is sufficiently discharged to bring the switching element 12 into the non-conductive state. When the supply voltage $V_1$ rises ($T_1 - T_2$ in FIG. 7*a*), the potential at the terminal G rises ($T_1 - T_2$ in FIG. 7*b*), and the gate current determined by the resistance 13 flows from the gate G to the cathode K. Since the current is small, the potential of the terminal K is nearly zero, and the gate current increases gradually. When the anode voltage $V_A$ rises up to a certain value $V_{Bo}$, the gate current becomes a value enough to turn the switching element 12 on, and the switching element is closed at a time $T_2$ (time $T_2$ in FIG. 7*c*).

Thus, a current flows from the power source 1, the choke coil 2, the switching element 12 and the capacitor 15 ($T_2$–$T_3$ in FIG. 7*c*) to charge the capacitor 15, so that the potential $V_K$ of the cathode K rises ($T_2$–$T_3$ in FIG. 7*b*). Immediately after the time $T_2$, the potential $V_G$ of the gate terminal G rises. Once it has reached a limiting voltage, it is thereafter kept at the fixed value. In the period from $T_2 - T_3$, the potential $V_K$ of the cathode terminal K rises. When it becomes greater than the gate potential $V_G$, a reverse bias is applied between the gate and the cathode. When, due to the reverse bias state, the reverse current from the gate G becomes a value obtained by dividing the anode current by the turn-off gain, the switching element 12 turns off (time $T_3$ in FIG. 7*c*). Simultaneously therewith, since the switching element 12 is reverse-biased, the period of time in which the switching element 12 turns off is shortened and the element becomes cut-off in a short time. The production of a high voltage pulse is therefore effected.

In this way, a pulse voltage is generated across the capacitor 3 (time $T_3$ in FIG. 7*c*). At this time, the capacitor 15 is sufficiently charged, and the potential of the cathode K is higher than the limiting voltage of the voltage limiting element 14, i.e., the gate voltage $V_G$ (time $T_3$ in FIG. 7*b*). Therefore, the switching element 12 is not turned on again by the generated pulse.

Since the switching element 12 is a unidirectional one, the non-conductive state is held until the potential $V_A$ of the anode terminal A becomes the value $V_{Bo}$ in the forward direction (period $T_3$–$T_6$ in FIG. 7*c*).

Meanwhile, the capacitor 15 completes the discharge through the discharging resistance 16, and the cathode potential $V_K$ returns to the original state ($T_3$–$T_4$ in FIG. 7*b*).

While a pulse is generated once in one cycle in the example in FIGS. 7*a* – 7*c*, a plurality of pulses can also be produced in one cycle by the selection of the voltage limiting element 14, the capacitor 15 and the discharging resistance 16.

When an impedance such as resistance is inserted in series with the principal circuit, pulse generation is also possible by use of a DC power source.

As is explained in connection with FIGS. 7*a* – 7*c*, the embodiment in FIG. 6 can generate the high voltage pulse after causing the half-wave current to flow. It is, therefore, applicable as the starter of a filament preheating type fluorescent lamp.

A device in that case is illustrated in FIG. 8 FL designates a fluorescent lamp, and 17 a voltage limiting element. It is desirable for the fluorescent lamp starter that a filament pre-heating current is caused to flow during a half cycle in the forward direction and that when the current stops flowing, a required pulse voltage is generated at the smallest possible current value.

In order to realize the conditions in the embodiment of FIG. 6, the effective capacitance of the capacitor 15 may be made large. In the embodiment of FIG. 8, the voltage limiting element 17 (here, Zener diode) is added to the capacitor 15 so to that the capacitance of the capacitor 15, per se, may be small. Thus, the maximum value of the cathode potential is limited to a value greater than the limit value of the gate potential, and the switching element 12 is turned off at the minimum current value required for obtaining the pulse voltage.

In the embodiment shown in FIG. 8, since the voltage limiting element 17 is also employed, the switching element 12 becomes reverse-biased by the voltage difference between the elements 14 and 17, and the cut-off current $I_{off}$ can be set at a predetermined magnitude. The magnitude of the generated pulse can be made to have a fixed value by the voltage limiting element 17, so that the fluorescent lamp and the capacitor are prevented from being deteriorated by an excessive pulse.

FIG. 9 is a diagram which shows a modification of the embodiment in FIG. 8. Parts 14', 14'' and 18 are diodes, whose on voltages are used to effect the voltage limitation. The sum of the on voltages of the diodes 14' and 14'' forms the voltage of the voltage limiting element 14, while the sum of the on voltages of the diodes 18, 14' and 14'' forms the voltage of the element 17. Numeral 19 indicates a protective resistance.

FIG. 10 illustrates a circuit arrangement in which the part of the switching circuit 5 enclosed by one-dot chain lines in FIG. 6 is employed through the full-wave rectification of full-wave rectification means REF, so as to generate filament pre-heating and starting pulses of the fluorescent lamp at every half cycle.

FIG. 11 illustrates a circuit arrangement to which is added the function of reducing the number of times of the pulse generation in order to make the filament life of the discharge lamp long. More specifically, it is so constructed as to produce a pulse in such a way that the capacitor 15 is charged through a resistance 20 and a diode 21 and that it is discharged once in a plurality of cycles by a diode 23 and a voltage switch 22 such as an SSS and Diac. With this circuit arrangement, when the anode current stops flowing under the action of the voltage limiting element 17, switch 22 breaks over and the pulse is produced. The resistance element 19 serves for protection.

FIG. 12 illustrates a modification of the embodiment of FIG. 6 in which the capacitor 3 determining the oscillation frequency is used in place of the capacitor 15.

In this manner, an operation similar to that of the embodiment of FIG. 6 can be expected. Reference numeral 24 indicates a diode for charging. The diodes 14' and 14'' supply a voltage for turning the switching element 12 on, by the on voltages thereof. The diode 18 serves to apply a reverse bias to the switching element 12.

In the above, description has been made of the case where the single semiconductor switching element with the control electrode is employed. The present invention, however, is not restricted thereto, but a switching device comprising two such switching elements in combination or a switching device comprising two transistors in combination can be employed.

Referring to FIG. 13, a part shown by dotted lines in a circuit illustrating the switching device which comprises transistors 12-1 and 12-2 and a resistance element in combination. That is, in the embodiment of FIG. 13, the switching element 12 shown in FIG. 8 is replaced with the circuit of the dotted line part. In FIG. 14, a part shown by dotted lines is the circuit which comprises two switching elements SCR 12-3 and 12-4 in combination, and which replaces the switching element 12 in FIG. 8.

FIG. 15 illustrates a voltage producing device in which a discharge lamp FL is connected to the embodiment of FIG. 6. The same symbols as in FIG. 6 indicate the same or equivalent parts. The discharge lamp FL has filaments $F_1$ and $F_2$. Shown at 107 is the parallel circuit consisting of a capacitor 15 and a resistance 16, as depicted in FIG. 6. A, G and K represent the anode, gate and cathode of the switching element 12 such as an SCR and a gate turn-off SCR, respectively.

The operation of the voltage producing device in FIG. 15 will now be described with reference to FIGS. 16*a* – 16*e*.

FIG. 16*a* shows the waveform of the voltage $V_1$ of the AC power source 1, FIG. 16*b* the waveform of the voltage $V_{GK}$ of the gate G relative to the cathode K, and FIG. 16*c* the waveform of a voltage $V_{FLD}$ applied to the discharge lamp FL and the waveform of a current flowing through the anode A or the pre-heating current $I_A$ flowing through the filaments $F_1$ and $F_2$.

FIG. 16*d* shows the waveform of a lamp voltage $V_{FL}$ corresponding to the lighting of the lamp, while FIG. 16*e* shows the waveform of the pre-heating current $I_A$ to be described later.

The explanation of the operation of the embodiment in FIG. 15 will proceed starting at a time $T_1$ at which the lamp FL is in the unlit state and the switching element 12 is in the off state. As the supply voltage $V_1$ increases on from $T_1$, it is applied to the lamp, a current flows through the resistance 13 and the voltage control element 14, and the voltage of the gate G increases as shown in FIG. 16*b*. Thus, the gate current increases, the switching element 12 turns on at a time $T_2$. The terminal voltage of the lamp at this time is represented by $V_{Bo}$ as indicated in FIG. 16*c*. Upon turn-on, anode current $I_A$ flows as shown in FIG. 16*c*. Then, as shown in FIG. 16*b*, the voltage of the cathode K rises and the gate voltage is kept at a predetermined negative voltage, so that a current flows out of the gate in a direction of turning the switching element off. Thus, the cut-off current $I_{off}$ at the time when the anode current $I_A$ for pre-heating the filaments stops flowing becomes a predetermined value, and the switching element turns off at a time $T_3$. As a result, a pulse voltage $V_p$ for igniting the lamp is successively generated. Until a time $T_4$ at which the pulse voltage is attenuated, the gate voltage $V_G$ is kept negative, and the switching element is not turned on again by the pulse voltage. When, upon repetition of the pre-heating and the pulse generation in the half-wave period, the lamp conducts, a lamp current $I_{FL}$ flows as shown in FIG. 16*d* and the lamp voltage becomes the waveform as shown at $V_{FL}$. At this time, it is necessary to prevent the switching element from being turned on again by this voltage. To this end, it is necessary to make $V_{Bo} > V_r$ in the worst condition. Therefore, the phase $T_2$ of the turn-on is delayed and the current $I_A$ for pre-heating is small, which leads to the disadvantage that a long period of time is required until the lamp is ignited.

For pre-heating the filaments and generating a lamp starting pulse by the switching action of the unidirectional semiconductor switching element with the control terminal, it, accordingly, becomes necessary to realize a device for increasing the filament pre-heating current and thus enabling rapid ignition.

When the current begins flowing with a zero phase $T_1$ as in FIG. 16*e*, the period of time for storing energy in the choke coil 2 becomes long (that is, the DC bias is largely applied) in comparison with the case of FIG. 16*c*, and a current greater than $I_A$ in FIG. 16*c* flows as shown at $I'_A$. If, in this case, the circuitry has no resistance component, time $T'_3$ at which the current stops flowing will coincide with the time $T_5$, and the effective current value will be, at most, three times as large as a current value obtained by the series circuit consisting of the power source 1 and the choke coil 2. In FIG. 16*e*, the period of from $T'_3$ to $T_5$ becomes approximately ¼ cycle due to the filament resistance of the lamp and the losses of the choke coil and the SW part. A voltage $V'_A$ to be applied across the lamp appears during the period $T'_3 - T_5$, as is shown in FIG. 16*e* after the pulse generation as a voltage in the direction of non-conducting the switching element. The voltage in the blocking direction is sufficiently greater than the maximum value $V_r$ of the lamp voltage upon ignition.

The present invention can also provide a voltage producing device capable of the instant ignition with such a construction that the voltage in the direction of a non-conducting the switching element is previously charged in a capacitor, at the lamp starting operation, the switching element is turned on by the discharge of the capacitor at zero phase ($T_1$) at which the voltage across the lamp becomes the forward voltage of the switching element, and after the lighting of the lamp, the switching element is prevented from being turned on by the charged voltage of the capacitor.

FIG. 17 is a diagram showing the construction of the voltage producing device enabling instant ignition. The same symbols as in FIG. 15 indicate the same or equivalent parts. In FIG. 17, reference numeral 108 designates a resistance for preventing oscillation, 109 and 111 diodes for reverse blocking 110 the above-cited capacitor for charging, and 112 a resistance for controlling discharging. A resistance 117 serves to adjust the gate current and also functions as a gate protection resistance. In operation, when the switching element 12 is in the non-conductive state and is applied with the voltage in the blocking direction, the capacitor 110 is charged through the diodes 111 and 109 and the resistance 108. Upon completion of charging, with a decrease in the reverse voltage of the lamp, the capacitor 110 begins discharging via the resistance 117 as well as the gate G of the switching element 12 through the cathode K, the parallel circuit consisting of the voltage control circuit 107 and the element 14, and the resistance 112. When, in this state, the anode voltage becomes forward, the switching element 12 immediately turns on as the gate current is already flowing. Except that a sufficient filament pre-heating current is thus obtained, the operation until ignition is the same as in the device of FIG. 15. After the lamp has been ignited, the forward voltage of the switching element 12 is blocked by the diode 109, and the voltage in the blocking direction becomes small as previously explained. The voltage to be charged in the capacitor 110 is, accordingly, small, and the values of the capacitance 110, the resistance 112 and the resistance 117 may be appropriately determined so as to prevent the switching element 12 from being turned "on" by the corresponding discharge current even when the forward voltage comes to be applied to the switching element 12.

According to the device of FIG. 17, the filament pre-heating current of the lamp becomes approximately twice as much as in the device of FIG. 15, and the period of time required for starting the lamp becomes substantially ½. With such a construction, the generated pulse voltage is held by the backward withstand voltage of the diode 109, so that the backward withstand voltage must be made greater than the produced pulse voltage. In some cases, it must be, for example, approximately 1,000 volts, and the voltage on capacitor 10 also becomes large.

Figure 18:
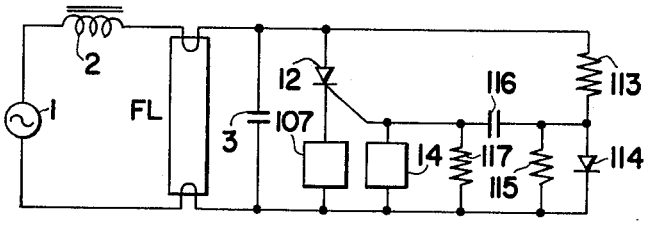

FIG. 18, illustrates a voltage producing device which is suitable also to the case set forth above in connection with FIG. 17. Numerals 113 and 115 denote voltage divider resistances, 116 a charging capacitor, 117 a charging control resistance, and 114 a short-circuiting diode for the forward voltage.

In operation, the backward voltage is divided by the resistances 113 and 115. Through the resistance 117, the capacitor 116 is charged to a voltage value proportional to the backward voltage, for example, several volts. Upon completion of the charging of capacitor 116, the operation shifts to the discharging and the gate current begins flowing as in FIG. 17. When the voltage is applied in the forward direction, switching element 12 is immediately turned on, and the lamp is ignited as in the operation of FIG. 17. The operation after the shift to the lighting is also similar to the case of FIG. 17 since the forward voltage is short-circuited by the diode 114. With this circuit arrangement, the resistance 113 should desirably be made so high as not to considerably absorb the pulse voltage.

In FIGS. 17 and 18, the charging control resistance 117 may be replaced with a temperature sensor such as thermistor, or may have the temperature sensor connected in series therewith. With this measure, the gate sensitivity characteristic of the switching element 12 dependent on the temperature can be improved. More specifically, when the temperature increases the gate sensitivity improves when the temperature drops the gate sensitivity decreases. Using the temperature sensor such as thermistor, therefore, the resistance value may be varied in dependence on the temperature.

Figure 19:
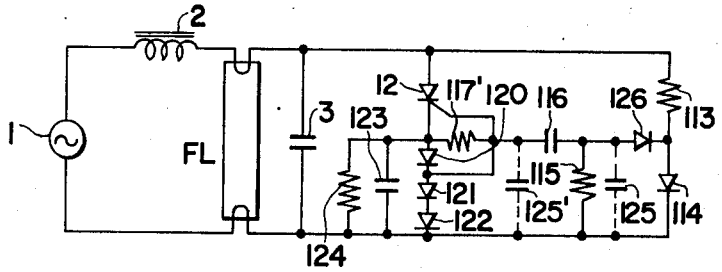

FIG. 19 illustrates a voltage producing device which serves to stabilize the lamp starting operation of the device of FIG. 18. A resistance 117' differs in position from the resistance 117, but effects the same function. Since the on voltage of the diode 114 based on the forward voltage at ignition of the lamp is so applied as to cause the turn-on current of the switching element 12 to flow, a diode 126 is provided in order to prevent voltage application. This diode can be substituted by a resistance.

In FIG. 19, numeral 120 designates a diode for imparting a reverse bias to the switching element 12. Diodes 121 and 122 are connected in series, and generate a voltage for turning the switching element 12 on by the on voltages thereof. The parallel circuit 17 of FIG. 18 is constructed of a resistance 124 and a capacitor 123. The diodes 121 and 122 correspond to the diode 14 of FIG. 18.

In the circuit arrangement of FIG. 19, an integration circuit is formed of the resistance 113 and capacitor 116. The switching element 12 is accordingly prevented from turning on again due to the pulsating voltage applied to the lamp FL. A stabilized operation is therefore effected. In order to enhance the integration effect, a capacitor may be inserted as shown at 125 or 125'.

Figure 20:
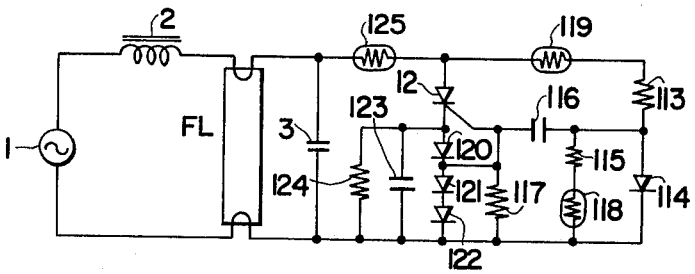

FIG. 20 shows an embodiment with the device of FIG. 18 improved. The control circuit of FIG. 15 for the gate and cathode voltages is constituted of diodes 120, 121 and 122, a capacitor 123 and a resistance 124. Numeral 118 indicates a thermistor, while numerals 119 and 125 denote heat-responsive elements such as posistors. This circuit arrangement has a large pre-heating current. Therefore, when the lamp is not lit, for example, at the last stage of the life time of the lamp and the lamp starting circuit repeats the operation for a long period of time, it is feared that the choke coil will be overheated. For this reason, any one of the heat sensors 118, 119 and 125 is incorporated so as to prevent overheating of the choke coil. When heat is generated, the elements 118 and 119 diminish the charged voltage of the capacitor 116. The element 125 diminishes the pre-heating current caused to flow due to the heat generation.

Figure 21:
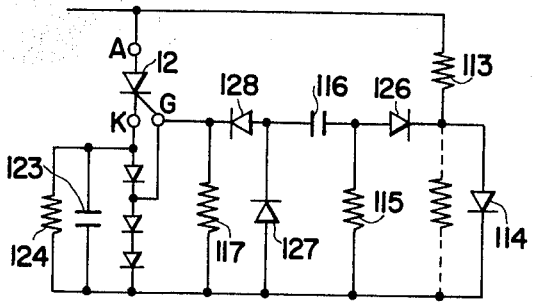

FIG. 21 shows still another embodiment of the present invention, which is a circuit for reliably effecting the lighting and non-lighting of the discharge lamp by the device of FIG. 18. Resistance elements 113 and 115, diodes 114 and 126 and a capacitor 116 perform the same functions as in the device of FIG. 19. Diodes 127 and 128 are connected to the capacitor 116. With the diodes 127 and 128, the difference between the voltages to be applied to the gate G at the lighting and non-lighting is made comparatively great, whereby the lighting operation is reliably carried out. The diode 114 may be replaced with a resistance as shown by dotted lines.

In the above embodiment, only on SCR has been referred to as a unidirectional triode semiconductor switching element. The present invention, however, is not restricted thereto, but a similar effect is achieved with another switching element which performs the same operation as an SCR.

Figure 22:
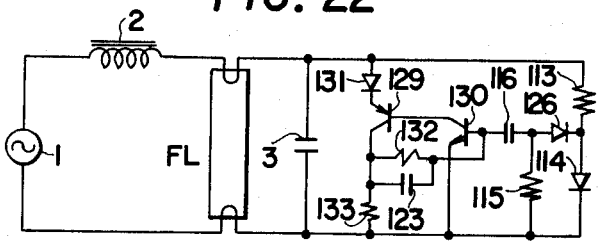

FIG. 22 shows an embodiment in which a circuit comprising two transistors in combination is employed as such another switching element. In the figure, transistors 129 and 130 and resistance elements 132 and 133 provide an equivalent circuit. Numeral 131 designates a diode for the backward withstand voltage between the base and emitter of the transistor 129. The same symbols as in the foregoing circuit arrangement indicate elements which perform the same functions, respectively.

In the above, description has been made of the embodiments wherein in order that, for generating a voltage by the use of the unidirectional semiconductor switching element with the control terminal, the generated voltage may be prevented from being absorbed by the switching element, the reverse bias voltage is passively supplied to the switching element. The present invention, however, is not restricted thereto, but it is also possible to actively supply a reverse bias voltage.

Figure 23:
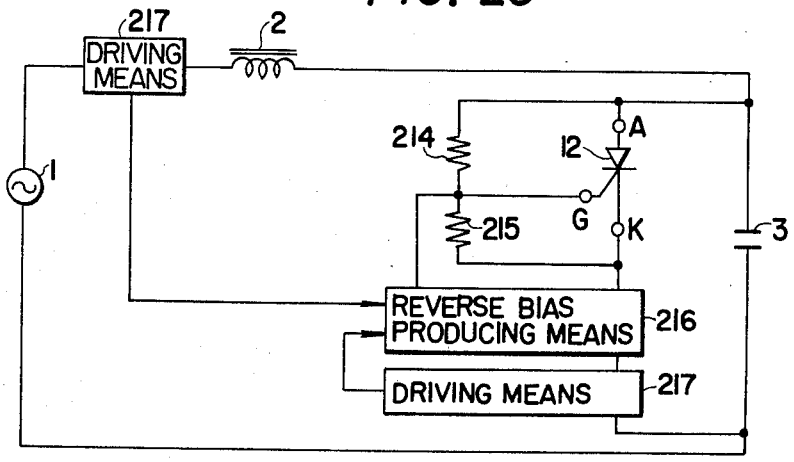
FIG. 23 is a diagram for explaining the operating principle of a further embodiment of the present invention.

FIG. 23 is a diagram for explaining the operating principle of actively supplying the reverse bias voltage to the switching element. In the figure, the same symbols as in FIG. 15 indicate the same or equivalent parts. Numerals 214 and 215 designate resistances for turning the switching element 12 on. Reverse bias producing means 216 serves to supply the reverse bias to the switching element 12 to turn it off. Driving means 217 drives the reverse bias producing means 216. The reverse bias is actively supplied to the switching element 12 by the reverse bias producing means 216 and the driving means 217.

The driving means 217 may be connected in any of cases illustrated in the figure.

FIG. 24 shows another embodiment of the present invention. A part 216 enclosed by broken lines is the reverse bias producing means. Shown at 218 is a non-linear voltage limiting element, which is herein a Zener diode. A part 217 surrounded by broken lines is the driving means. Shown at 219 is a unidirectional triode semiconductor switching element such as SCR. Numerals 220 and 222 represent non-linear voltage limiting elements, which are herein a Zener diode and a diode, respectively. Numeral 221 designates a capacitor, and 223 a resistance.

The operation of the embodiment in FIG. 24 will now be explained with reference to FIGS. **25*a*–25*e*.**

FIG. **25*a* shows the voltage waveform of the AC power source 1, FIG. 25*b* the waveform of the terminal voltage $V_R$ of the resistance 23, FIG. 25*c* the waveform of the terminal voltage $V_C$ of the capacitor 21, and FIG. 25*d* the gate potential $V_G$ of the switching element 12 relative to the cathode. FIG. 25*e* shows the anode potential $V_A$ (solid line) of the switching element 12 relative to the cathode, and the anode current $I_A$ (broken line) of the switching element 12.**

First, the voltage $V_1$ of the AC power source 1 begins rising at a time $T_1$, and the gate voltage $V_G$ rises in proportion to the voltage $V_1$. When the supply voltage reaches the value $V_{Bo}$, the gate voltage of the switching element 12 reaches the trigger gate voltage. The switching element 12 turns on, so that the anode current $I_A$ of the switching element 12 flows through the resistance 223. The terminal voltage $V_R$ of the resistance 223 rises as shown in FIG. **25*b*, and it is clipped by the Zener voltage $V_{Z20}$ of the Zener diode 220.**

Meanwhile, a voltage obtained by subtracting the on voltage $V_{Z22}$ of the diode 222 from the voltage $V_R$ is developed across the capacitor 221 as it changes. The developed voltage becomes the saturation value at the maximum value of $V_R$. Thereafter, the anode current $I_A$ begins to decrease, and the terminal voltage of the resistance 223 decreases. At this time, the difference between the terminal voltage $V_C$ of the capacitor 221 and the terminal voltage $V_R$ of the resistance 223 is applied across the gate and cathode of the SCR 219. Herein, the voltage $V_C$ is fixed. Therefore, when the anode current $I_A$ decreases and the value $(V_C - V_R)$ reaches the trigger gate voltage of the SCR 219, the SCR 219 becomes conductive. A reverse bias produced by subtracting the on voltage of the SCR 219 from the Zener voltage $V_{Z18}$ of the Zener diode 218 is applied to the gate of the switching element 12, with the result that the switching element 12 becomes the cut-off state. A pulse voltage $V_P$ is generated by the anode current $I_{A\ off}$ flowing at this time. Moreover, since the SCR 219 is conductive at the generation of the pulse voltage, the switching element 12 is not again brought into the conductive state by the pulse voltage.

In this manner, the time for applying a reverse bias to the switching element 12 can be determined by setting the Zener voltage of the Zener diode 220, the on voltage of the diode 222 and the resistance value of the resistance 223 at predetermined values. In other words, in a current region in which the switching element 12 can be cut off by applying the reverse bias across the gate and cathode thereof, the switching element 12 can be cut off at a predetermined current value. More specifically, even when the cut-off characteristics differ due to the dispersion of the elements and the temperature characteristic, the switching elements 12 can be cut off at the fixed current. Therefore, the generated pulse voltages become constant, and stable high-voltage-pulse generator circuits can be provided.

Figure 26:
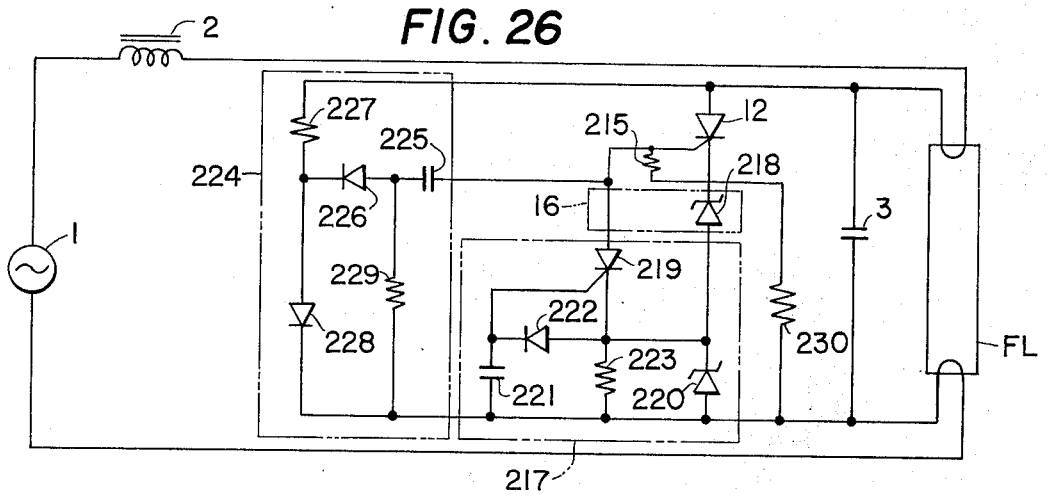
FIGS. 26–30 are diagrams showing the constructions of still further embodiments of the present invention.

An embodiment in FIG. 26 has such a construction that a pre-heating current increasing circuit enclosed by broken lines 224 is added to the embodiment in FIG. 24. The operation of the pre-heating current increasing circuit shown in the embodiment will be briefly explained. During a half cycle in which the anode side of the switching element 12 is negative, a capacitor 225 is charged through resistances 230 and 215, the capacitor 225, a diode 226 and a resistance 227, so that the gate side terminal of the switching element 12 may have a positive potential. The gate voltage is applied across the gate and cathode of the switching element 12 via the capacitor 225 and through resistances 215, 230 and 229. For this reason, the switching element 12 becomes conductive at the same time than the anode side of the switching element 12 reaches a positive potential. The conduction time of the switching element 12 accordingly increases, so that the pre-heating current can be increased. A diode 228 is used in order to prevent the pulse voltage from being applied in the backard direction of the diode 226.

Also, where the pre-heating current increasing circuit of such operation is added, a stable pulse voltage can be acquired by employing the reverse bias producing means 216 and the driving means 217 previously set forth.

Figure 27:
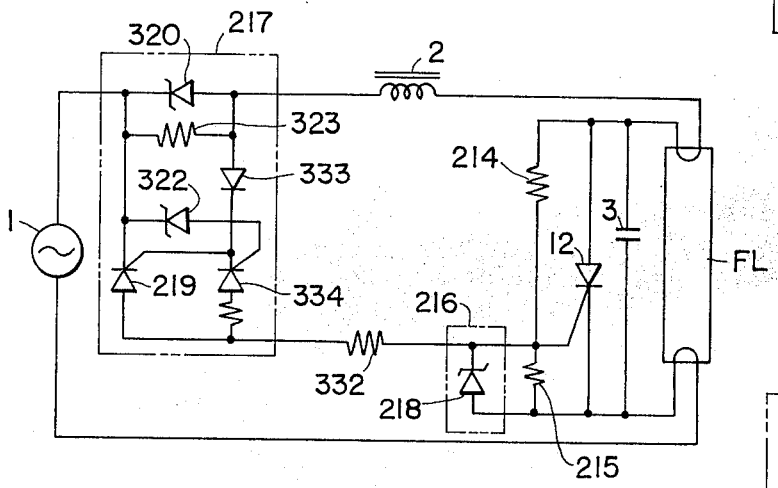

The embodiment in FIG. 27 is a circuit arrangement which obtains the reverse bias voltage of the switching element 12 from the power source side. In the figure, the same symbols as in FIG. 24 designate the same or equivalent parts.

When the supply voltage is applied across the switching element 12, the voltage divided by the resistances 214 and 215 is applied across the gate and cathode of the switching element 12. The switching element 12 becomes conductive, and anode current flows. Due to this current, a voltage $V_R$ is developed across a resistance 323. This voltage is clamped by the Zener voltage $V_{Z20}$ of a Zener diode 320. Therefore, when the voltage $V_{Z20}$ is set to be greater than the sum of the Zener voltages $V_{Z22}$ and $V_{Z33}$ of Zener diodes 322 and 333 and the trigger gate voltage of an SCR 334, the trigger gate current is permitted to flow to the gate of the SCR 334 before $V_R$ is clamped by $V_{Z20}$. Since, however, the anode of the SCR 334 has a negative potential during the rise of the anode current, the SCR cannot become the conductive state. When the current decreases due to the delay current effect of the coil 2, the anode side of the SCR 334 reaches a positive potential and the SCR 219 becomes conductive. At this time, a voltage obtained by subtracting $V_R$ from $V_{Z33}$ is applied across the gate and cathode of the SCR 219. Therefore, when the current flowing through the resistance 323 decreases and the value $(V_{Z33} - V_R)$ becomes greater than the trigger gate voltage to the SCR 219, the element 219 conducts. By way of a diode 331 or a Zener diode, the reverse bias voltage is applied across the gate and cathode of the switching element 12, to cut if off. In this manner, a pulse voltage generator circuit having the constant-current cut-off characteristics can be obtained by the values of $V_{Z20}$, $V_{Z22}$ and $V_{Z33}$ and the resistance value of the resistance 323. In FIG. 27, a resistance 332 is for protection.

Figure 28:
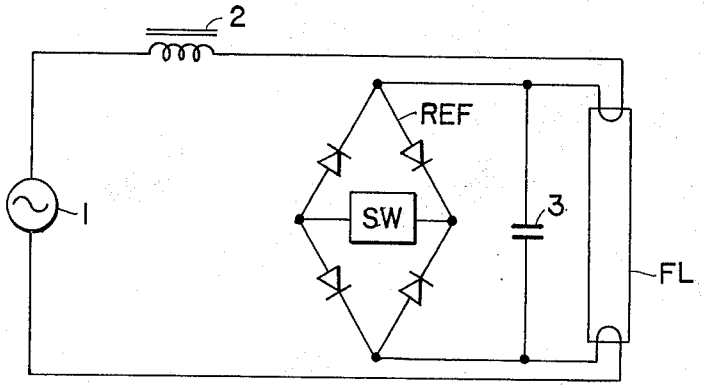

FIG. 28 illustrates a circuit arrangement in which the part Sw surrounded by one-dot chain lines in FIG. 24 is employed through the full-wave rectification of full-wave rectification means REF, so as to generate filament pre-heating and starting pulses of the fluorescent lamp at every half cycle.

Description has been made above of only the case where a single element is used as the unidirectional triode semiconductor switching element. Of course, the present invention is not restricted thereto, but it is applicable to a case whre two SCRs or a circuit comprising two transistors in combination is employed as the switching element.

Figure 29:
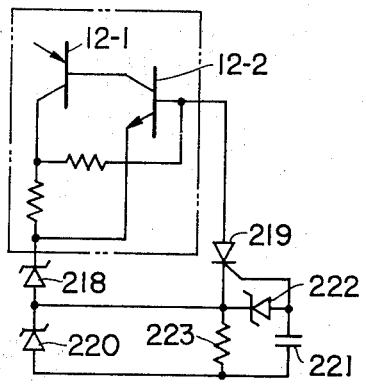

In FIG. 29, the part shown by broken lines is the circuit which comprises two transistors 12-1 and 12-2 and a resistance element in combination.

Figure 30:
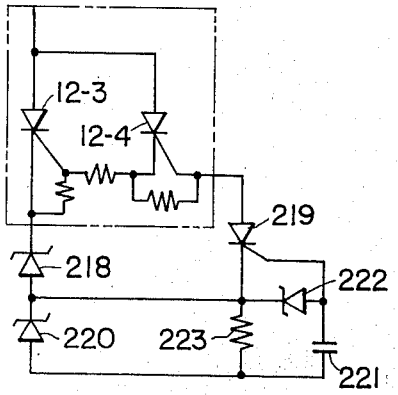

FIG. 30 shows a circuit in which the switching element 12 illustrated in FIG. 14 is replaced with a circuit comprising two SCRs 12-3 and 12-4 and a resistance in combination as depicted by a broken-line part.

If a temperature sensor having a negative temperature characteristic, such as a thermistor, is employed for the resistance of each circuit, for example, the resistance 323 in FIG. 24, the anode cut-off current $I_{A\ off}$ of the switching element 12 can be varied with time, and the pulse voltage can be gradually increased from the closure of a power switch.

On the other hand, if a temperature sensor having a positive temperature characteristic, such as posistor, is employed for the resistance 323, the anode cut-off current $I_{A\ off}$ of the switching element 12 can be varied by changes in the ambient temperature. When the ambient temperature is lowered, the pulse voltage can be raised.

As stated above, according to the present invention, using an SCR or a like unidirectional semiconductor switching element with a control electrode, the stable operation of cutting off the fixed current is effected with simple construction, and even when the switching elements are dispersed and their cut-off characteristics change in dependence on temperature, the high voltage pulses required for, e.g., the discharge lamp can be readily obtained.

Further, in the above description, the unidirectional semiconductor switching element with the control terminal and the AC power source are connected through the coil. The present invention, however, is not restricted thereto, but it is also possible to construct current limiting means by connecting a capacitor in series with the coil and to passively supply to the switching element a voltage for causing the switching element to turn off.

When such current limiting means is connected to the switching element, it becomes possible that the period during which the switching element is in the turn-off state is adjusted by the passive circuit for supplying the voltage.

FIG. 31 is a diagram for illustrating the principle of a device which produces a high voltage with the current limiting means consisting of the coil and the capacitor. In the figure, numeral 1 designates an AC power source, 2 a coil, 415 a capacitor connected in series with the coil 2, and 416 the equivalent resistance of the circuit. FL indicates a discharge lamp. Shown at 5 is a switching circuit which is turned off when the current ends flowing and which turns on after sustaining the turn-off state for a predetermined period of time. The coil 2 and the capacitor 415 constitute the current limiting means, which serves also as the ballast of the discharge lamp FL.

The operation of the device in FIG. 31 will be explained with reference to FIGS. 32*a*–32*c*.

FIG. 32*a* shows the waveform of the supply voltage $V_1$, FIG. 32*b* the waveforms of the voltage $V_{TS}$ and current I across the lamp FL or across the switch 5, and FIG. 32*c* the waveform of the charging and discharging voltage of the capacitor 415. Letter *t* indicates the time axis. Times $t_1$–$t_7$ on the time axis of FIG. 32*a* are set in order to facilitate the explanation.

First, in the state in which the capacitor 415 is charged to a voltage $V_{c,\,n-1}$, the switch 5 is open (i.e., off) for the predetermined period from the time $t_1$ to $t_3$. Thereafter, it turns on or is closed at $t_3$. The voltage of the switch 5 in the period $(t_1 - t_3)$ in which it is open has such a waveform that the supply voltage $V_1$ is superimposed on the capacitor voltage (the same applies hereunder). During the period from the time $t_3$ to $t_4$, the oscillation current of the current limiting means flows by a component corresponding to a half cycle, and the current returns to the zero state. Therefore, if the capacitor voltage at the time $t_3$ and the mean value of the supply voltage in the on period $t_3 - t_4$ of the switch 5 are in the directions of being added to each other, the following equation can be held by regulating $T_{on}$ and $T_{off}$:

$$V_{c,\,n} \geqq V_{c,\,n-1} \qquad (1)$$

where $V_{c,\,n-1}$ denotes the capacitor voltage in the period $t_1 - t_3$, while $V_{c,\,n}$ represents the capacitor voltage in the period $t_4 - t_6$.

Equation 1 is satisfied for the condition that the first capacitor voltage $V_{c\,1}$ (immediately after the closure of the switch) is equal to zero. Accordingly, with a circuit arrangement satisfying the conditions, the voltage across the switch 5 gradually increases every half cycle. The current also increases with the voltage, and when energy dissipated by the circuit resistance 416 and energy injected from the power source 1 become equal, both the sides of Equation 1 become equal. At this time, the voltage increase ceases.

The end of the voltage increase also occurs at a time at which the conduction phase $t_3 - t_4$ of the switch 5 moves and the mean value of the supply voltage in that period becomes zero. Therefore, if the firing voltage of the discharge lamp FL is so set as to become lower than the saturation voltage, the discharge lamp FL will shift to discharge.

In this way, by suitably regulating the lengths of the on period and off period of the switch 5 in the circuit of FIG. 31, the voltage across the switch 5 or across the discharge lamp FL can be increased to a necessary and sufficient value for firing of the discharge lamp. By stopping the operation of the switch 5 after the firing of the discharge lamp FL, the lamp can maintain a stable discharge.

As described above, according to the present invention, the voltage required for starting the discharge lamp is obtained. In addition, the current caused by the oscillation of the current limiting means as flows through the circuit is greater than the current flowing during the lighting of the discharge lamp FL. The present invention is, therefore, suitable for the starter of the filament pre-heating type discharge lamp.

FIGS. 33 to 37 illustrate further embodiments.

In FIG. 33, the same symbols as in FIG. 31 indicate the same or equivalent parts. The series circuit consisting of the coil 2 and the capacitor 415 forms the ballast of the discharge lamp FL. The switch 5 is constructed as shown inside broken lines. FLS designates a bidirectional triode semiconductor switching element, and Diac a trigger diode switch. A capacitor 417 and resistances 418 and 419 constitute an integration circuit. In operation, when the lamp is unlit, the switch FLS is in the off state, and the capacitor 417 is charged through the resistance 418 by the terminal voltage of the switch FLS. When the charged voltage becomes greater than the turn-on voltage $V_{Bo}$ of the trigger diode switch Diac, the switch Diac becomes the on state, to turn the switch FLS on. Thus, during a period $T_{on}$ determined by the oscillation period of the current limiting means, the current flows in one direction and heats the filament of the discharge lamp FL.

Meanwhile, the charges in the capacitor 417 are discharged by the resistance 419, and the voltage becomes zero. When the current stops flowing, the switch FLS turns off, and a voltage with the voltage of the capacitor 415 and the supply voltage superposed is impressed across the switch FLS. Thus, the capacitor 417 is charged again. When the charged voltage becomes the voltage $V_{Bo}$ of the switch Diac, the switch FLS turns on again. Accordingly, the off period $T_{off}$ is determined by the charging rate of the capacitor 417, which in turn is determined by the voltage across the switch FLS and the values of the components 417, 418 and 419. By repeating such operation, the voltage across the switch 5 increases. In this manner, the current flows through the filament, and the high voltage is applied across the discharge lamp FL. Therefore, when the filament is sufficiently heated, the discharge lamp FL is ignited. When the lamp is lit, the mean voltage across the switch FLS lowers. Since the capacitor 417 is charged to a voltage proportional to the terminal voltage of the switch FLS, the voltage of the capacitor 417 is lower than the voltage $V_{Bo}$ of the switch Diac during lighting. Consequently, the switch FLS is off, and maintains the normal lighting of the discharge lamp.

Figure 34:
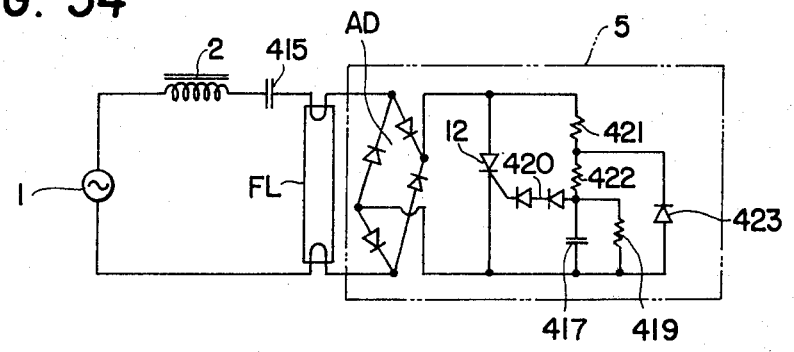

An embodiment in FIG. 34 employs a unidirectional gate control switch, for example, an SCR in place of the bidirectional gate control switch. Since the switch 12 is unidirectional, it is inserted through a full-wave rectifier AD. Since the gate current is in one direction in the switch 12, the on voltages of several series diodes 420 are used in place of the on voltage of the switch Diac in FIG. 33. Neither the switch 12 nor the switch FLS turns on unless a voltage greater than approximately the on voltages of the diodes 420 and the switch Diac is applied between the gate and cathode. Therefore, where the off time may be short, the switch Diac or the diodes 420 need not be positively inserted in some cases. Further, with the circuit of FIG. 33, when the terminal voltage of the switch 5 becomes high, the off time $T_{off}$ becomes short, and hence, the voltage cannot become very high. Therefore, the embodiment of FIG. 34 divides the resistance 418 in FIG. 33 into resistances 421 and 422 and connects a Zener diode 423, so as to prevent the off time from becoming short even when the voltage of the switch 5 becomes a great. The Zener diode is not restrictive, but there may be employed any element having a suitable constant-voltage characteristic, for example, a constant-voltage element such as ZNR varistor and SiC varistor. Also, in the case of FIG. 33, the same effect is achieved by a connection similar to that of FIG. 34 with the bidirectional constant-voltage element such as a ZNR varistor and an SiC varistor.

Figure 35:
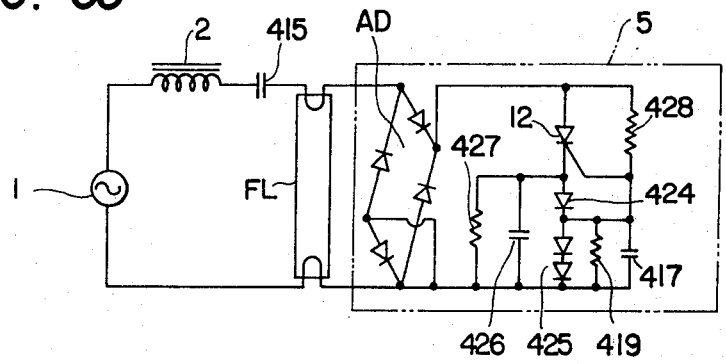
Figure 36:
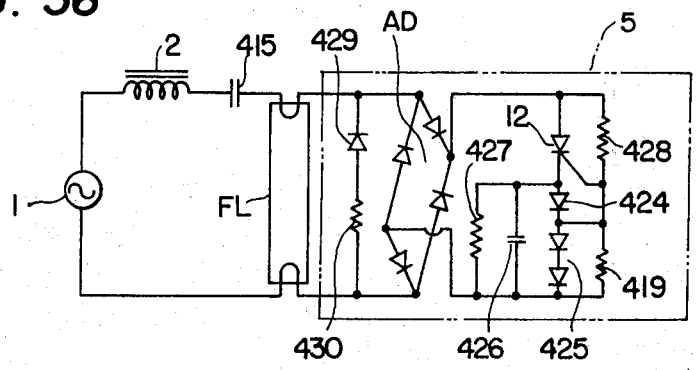

With the embodiments of FIGS. 33 and 34, where a long off time, for example, over ¼ cycle is required, it is sometimes difficult to turn-on the switch 12 or the switch FLS after the closure of the switch. FIGS. 35 and 36 illustrate circuits which are suitable in such a case.

In the circuit of FIG. 35, numeral 424 designates a diode for applying the reverse bias across the cathode and gate of the switch 12. Shown at 425 is a series connection of two diodes, whose on voltages are used to apply a voltage for the turn-on of the switch 12 to the gate. Numeral 426 indicates a capacitor, and 427 a resistance. The off time $T_{off}$ is regulated by the time constant of the capacitor 426 and the resistance 427. Although the capacitor 417 and the resistance 419 are of the same connection as in FIG. 34, the capacitance of the capacitor 417 is selected to be small. Thus, the capacitor 417 functions only to prevent the turn-on of the switch 12 due to the peak of the tube voltage during the lighting, and does not take part in the determination of the off time. Numeral 428 denotes a resistance element.

In operation, in the state in which the capacitor 426 is perfectly discharged, a voltage is applied to the switch 12. Then, the terminal voltage of the resistance 419 increases, and current for turn-on flows through the gate of the switch 12. Thus, the switch 12 turns on, and current flows through the anode of the switch 12 for a time interval determined by the oscillation period of the current limiting means. The capacitor 426 is thereby charged to the on voltages of the diode 424 and the diodes 425. When the current becomes zero, the switch 12 turns off. At that time, since the capacitor 426 is charged, the reverse bias is applied across the gate and cathode to the amount of approximately the on voltage of the diode 424. Therefore, even when a great voltage below the breakdown voltage is applied, the switch 12 does not turn on. After the turn-off of switch 12, capacitor 426 is discharged through the resisance 427. Until the voltage required for the turn-on is applied to the gate again, the switch 12 keeps the off state. Once the discharge lamp FL has been lit, the voltage across it or the mean voltage across the switch 5 is lowered, and hence, the gate voltage of the switch 12 does not reach the required value for the turn-on.

The circuit arrangement of FIG. 36 has a feature in that, in order to facilitate the first turn-on after the closure of the switch 12 in the circuit arrangement of FIG. 35, a series circuit consisting of a diode 429 and a resistance 430 is connected across the fluorescent lamp FL. Of course, the value of the resistance 430 is made so large as not to hinder the stable lighting of the discharge lamp. As is well known, a ballast with a coil and a capacitor connected in series can maintain the stable lighting owing to its resonance action even in a region in which the difference between the supply voltage and the terminal voltage of the discharge lamp under lighting is small. In such a lighting condition, with the device of FIG. 35, it is difficult to select the values of the resistance 428, resistance 419 and capacitor 417, so as to keep the switch 12 in the off state after ignition of the discharge lamp. In contrast, with the device of FIG. 36, when the discharge lamp is unlit, the capacitor 415 by the diode 429 and the resistance 430. A voltage at most twice as high as the peak voltage of the supply voltage $V_1$ can be applied to the switch 5, and the first turn-on of the switch 12 is thus obtained. Thereafter the current flows through the circuit and the voltage is increased, so that the switch 5 sustains the operation until the discharge lamp becomes conductive. When the discharge lamp conducts, the applied voltage of the switch 5 becomes the lighting voltage of the discharge lamp. Accordingly, even when the supply voltage and the voltage across the discharge lamp during ignition are almost equal, the difference between the voltages across the discharge lamp for non-ignition and ignition are approximately the peak voltage value of the supply voltage, and the operation of the switch 5 at ignition can be readily stopped by the gate circuit constants of the switch 12. With the circuit of FIG. 36, the capacitor 417 for preventing the switch from being operated by the peak value of the lamp voltage is not necessary. As will be understood from the above explanation, the diode 429 and the resistance 430 can also be applied to the device of FIGS. 33 and 34.

Figure 37:
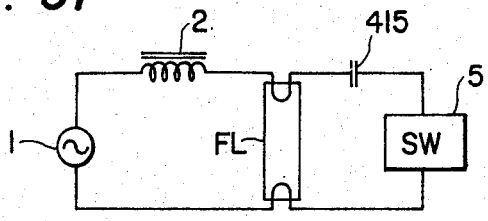

In the above, the ballast is constructed of the series connection of the coil and the capacitor. For a ballast constructed only of the coil, the starter can be formed in such a way that, as shown in FIG. 37, the capacitor 415 is connected in series therewith from the discharge lamp FL onto the side of the switch 5. The current for pre-heating is the same as in the foregoing. With respect to voltage, when the switch 5 is in the off state, only the supply voltage is applied to the discharge lamp, while when the switch 5 is on the voltage of the capacitor 415 is applied as it is. The waveform is that shown in the period $T_{on}$ in FIG. 32*c*. As is described with reference to FIG. 32*a* ~FIG. 32*c* this voltage has a magnitude sufficient for starting the discharge lamp.

While we have shown and described several embodiments in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are obvious to one of ordinary skill in the art.

We claim:

1. A voltage producing device comprising:

an AC power source;

current limiting means including a coil and a capacitor connected in series, one terminal of said current limiting means being connected to one terminal of said AC power source;

a first unidirectional semiconductor switching element having a current inflow terminal, a current outflow terminal and a control terminal, sasid first switching element having the other terminal of said current limiting means coupled to its current inflow terminal and having the other terminal of said AC power source coupled to its current outflow terminal;

first means for generating a zero voltage for bringing said first switching element into the turn-off state and for maintaining said turn-off state;

second means for generating a voltage for bringing said first switching element into the turn-on state, said means being applied with a voltage from said AC power source;

third means for applying a reverse bias across the control terminal and the current outflow terminal of said first switching element;

a discharge lamp having a first filament and a second filament; and full-wave rectification means, one terminal of said first filament and one terminal of said second filament being respectively coupled to said one terminal of said current limiting means and said other terminal of said power source;

the other terminal of said first filament and the other terminal of said record filament being respectively connected to an input portion of said full-wave rectification means, one output terminal of said full-wave rectification means being coupled to said current inflow terminal of said first switching element, one terminal of said first means and other terminal of said first means being respectively coupled to said control terminal of said first switching element and other output terminal of said full-wave rectification means, one terminal and other terminal of said first means being respectively coupled to said control terminal of said first switching elelement and other output terminal of said full-wave rectification means, one terminal and other terminal of said second means being respectively coupled to said one terminal and said other terminal of said first means, one terminal and other terminal of said third means being respectively coupled to said current outflow terminal of said first switching element and said one terminal of said first means.

2. A voltage producing device according to claim 1, wherein said first means comprises a first resistor element and a second capacitor.

3. A voltage producing device according to claim 1, wherein said second means comprises a voltage limiting means.

4. A voltage producing device according to claim 3, wherein said voltage limiting means comprises a plurality of series connected rectifier elements.

5. A voltage producing device according to claim 1, wherein said third means comprises a diode.

6. A voltage producing device according to claim 1, further comprising fourth means connected between said one terminal of said third means and said other terminal of said second means.

7. A voltage producing device according to claim 6, wherein said fourth means comprises a second resistor element and a third capacitor.

8. A voltage producing device according to claim 7, further comprising a third resistor element connected between said inflow terminal and said control terminal of said first switching element.

* * * * *